US005641013A

United States Patent [19]

Wingfield

[11] Patent Number: 5,641,013

[45] Date of Patent: Jun. 24, 1997

[54] STABILIZING CAMOUFLAGE BLIND

[76] Inventor: Charles Richard Wingfield, Rte. 8, Box 228, Buckhannon, W. Va. 26201

[21] Appl. No.: 555,185

[22] Filed: Nov. 8, 1995

[51] Int. Cl.[6] ..... E04F 10/00; A45B 25/14

[52] U.S. Cl. ..... 160/45; 160/53; 160/58.1; 135/25.32; 135/98; 124/87

[58] Field of Search ..... 160/45, 47, 53, 160/58.1, 65; 135/98, 99, 25.2, 25.31, 25.32; 124/86, 87, 88, 89

[56] References Cited

U.S. PATENT DOCUMENTS

| | | | |
|---|---|---|---|
| 1,053,337 | 2/1913 | Williams | 135/98 X |
| 2,711,182 | 6/1955 | Kiel et al. | 135/25.31 |
| 3,374,798 | 3/1968 | Samuelson | 135/99 X |
| 4,038,997 | 8/1977 | Smith | 135/98 X |
| 4,086,931 | 5/1978 | Hall | 135/98 |
| 4,977,677 | 12/1990 | Troescher, Jr. | 124/87 X |
| 4,984,372 | 1/1991 | Blizzard | 124/87 X |
| 5,193,565 | 3/1993 | Huang | 135/25.2 |

*Primary Examiner*—Kenneth J. Dorner
*Assistant Examiner*—Bruce A. Lev

[57] ABSTRACT

A stabilizing camouflaging blind which is attachable to an archery bow by means of a stabilizing rod adapted to fit the archery bow's stabilizer mounting hole. The stabilizer rod includes a round bracket and a sliding bracket to which the blinds support arms are attached. Included also is a camouflage curtain which attaches to the support arms and contains a sight window. The movement of the sliding bracket, which causes the support arms to extend and retract, determines the tautness of the camouflage curtain (ie: curtain is tightest when sliding bracket is in its foremost position). In addition, a predrilled hole, which is positioned to be below the sliding bracket in its foremost position, allows for the insertion of a security pin to hold the blind in its open position.

4 Claims, 3 Drawing Sheets

STABILIZING CAMOUFLAGE BLIND

SUMMARY OF THE INVENTION

The stabilizing camouflage blind according to the present invention consists of a stabilizing unit which not only allows the blind to be used as a camouflage blind, to conceal archer movement, but also as a stabilizer when in its collapsed position, which has been shown to reduce torque and increase bow performance.

The blind attaches by means of a stabilizing rod which threads directly into the stabilizer mounting hole on the front surface of the bow and extends forward perpendicular to the bow. On the opposing end of the stabilizing rod is attached a round bracket containing 8 proportionately spaced slots which accomodate seven tri-fold support arms. The eighth slot accomodates the secured ends of the safety wire. This wire is inserted through a hole in the end of each support arm and when the ends of the wire are secured, the support arms are forced into their appropriate slots in the round bracket on the end of the stabilizing rod.

Support arms are attached not only to the top round bracket but also to a sliding bracket which moves from the front to the back of the stabilizing rod. When sliding bracket is in its foremost position, support arms are fully extended and a pin is inserted through a hole in the stabilizing rod behind the sliding bracket and thus secures the blind from unwanted closure during use.

The camouflage curtain is attached to each support arm in various positions to ensure uniform tautness when the blind is in its extended position and to allow the curtain to fold properly when blind is collapsed. When extended, a sight window in the camouflage curtain, which is centered in respect to the bow's arrow rest, allows the archer to track game but keep movements, such as coming to full draw, hidden from view. When in its collapsed position, the support arms fold down parallel to the stabilizing rod which causes the camouflage curtain to be drawn closed with the arms and a safety strap may be used to secure the folds of the camouflage curtain around the stabilizing rod allowing the blind to be safely left on the archery bow. The attachment of the blind to the archery bow's stabilizer mounting hole, allows it to be collapsed and secured in such a position as to allow the archer to safely shoot over the blind while the blind itself remains on the bow to act as a stabilizer.

Further aspects and advantages of this invention will become more evident after consideration is given to the following detailed description of the preferred exemplary embodiments.

BRIEF DESCRIPTION OF THE ACCOMPANYING DRAWINGS

References will hereinafter be made to the accompanying drawings wherein like reference numerals throughout the various FIGURES denote the like structural elements and wherein.

DETAILED DESCRIPTION OF THE PREFERRED EXEMPLARY EMBODIMENTS

Figure 1:
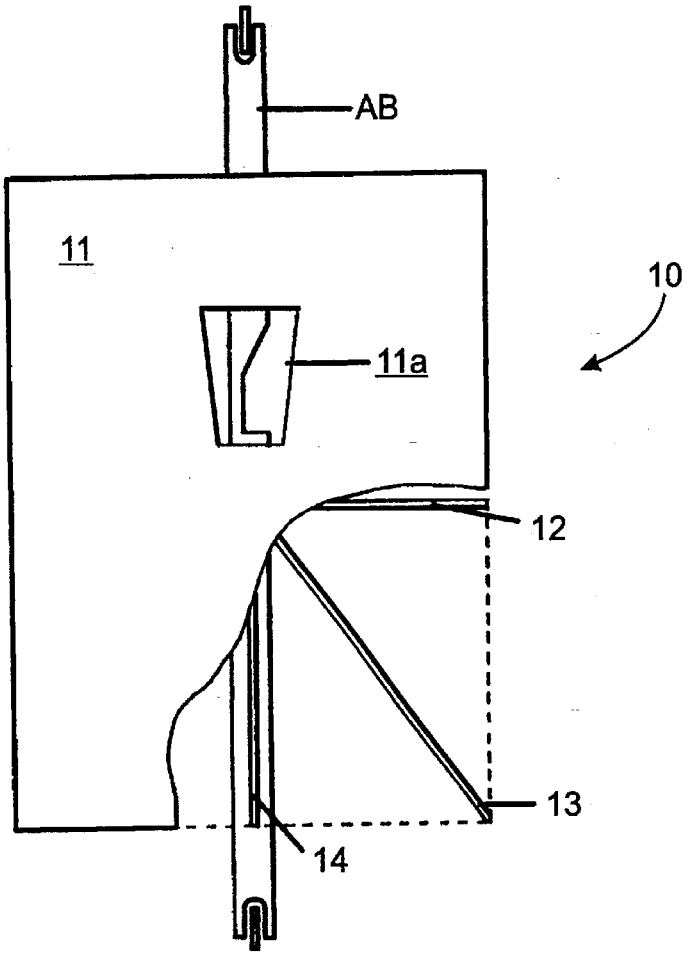
FIG. 1 is a front view showing a stabilizing/camouflage blind of this invention in an extended position as mounted to an archery bow by means of the bow's stabilizer mounting hole and also shows positioning of the sight window in respect to the arrow flight path.

The stabilizing/camouflaging blind 10 is shown in FIG. 1, as mounted to an archery bow AB, in its extended position. The stabilizing/camouflaging blind 10 includes a camouflage curtain 11 which (as shown in FIG. 1) contains a sight window 11*a* appropriately aligned with the archery bow's arrow rest to allow a clear arrow flight path and suitable game tracking. The camouflage curtain 11 is extended between seven support arms of three sizes which are represented by support arms 12, 13, and 14 as shown in FIG. 1 and may be constructed of any suitable lightweight material. Tri-fold support arms represented in FIG. 1 are detailed in, but not limited to, one possible form in FIGS. 3, 4 and 5.

Relative to FIG. 1, there are two support arms which are represented by support arm 12 and which extend horizontally from the center and are proportionately shorter in length than the other five support arms. (Detailed in FIG. 4.) Support arm 13 (as shown in FIG. 1), represents the four support arms which extend from the center, diagonally to the four corners of the camouflage curtain 11 and which are proportionately longer than the other arms (detailed in FIG. 3.). Support arm 14 (as shown in FIG. 1 and detailed in FIG. 5), is individual in length and extends down from the center to provide an even bottom edge for the camouflage curtain 11.

Figure 2:
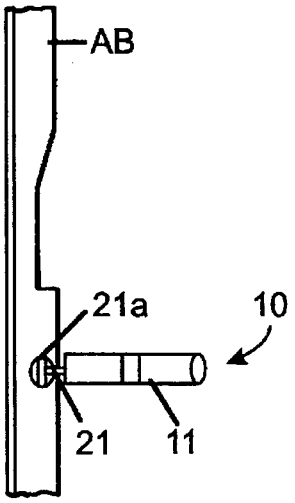
FIG. 2 shows a front perspective view of the blind shown in FIG. 1 in a collapsed, secured position as mounted on an archery bow and demonstrates the usage of the lock nut to secure the blind to the bow.
Figure 3:
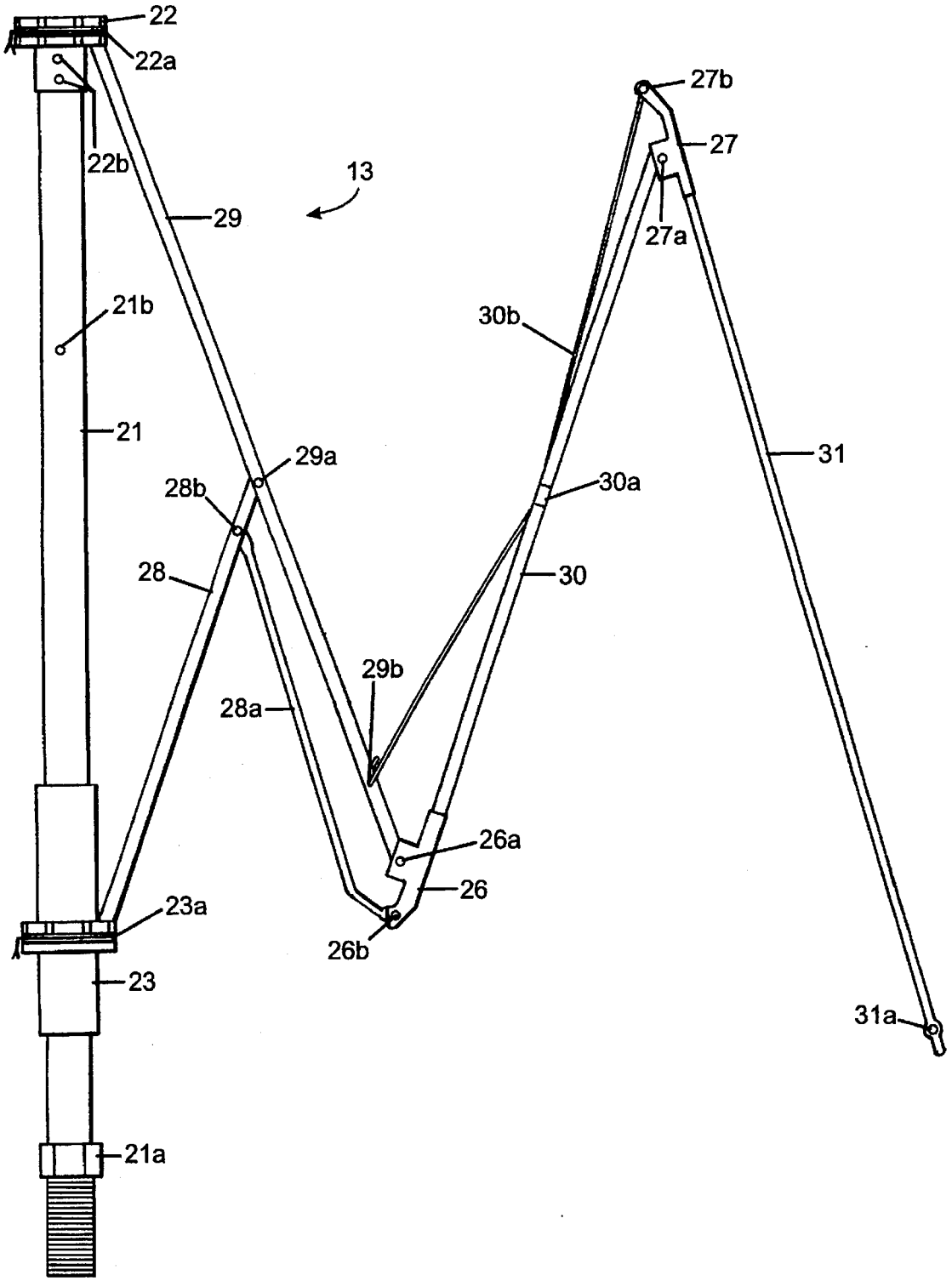
FIG. 3 shows a side view of the stabilizing support rod of the blind depicted in FIG. 1 with both round and sliding brackets attached as well as an example of an attached partially extended support arm and the lock nut which secures the blind to archery bow.

When deployed such as in FIG. 1, the archer is provided with a stabilized blind which effectively conceals archer movement, such as coming to full draw. In addition, the blind 10 may be collapsed and secured as shown in FIG. 2 and safely left on the archery bow AB as a stabilizing unit. Due to the fact that the blind 10 attaches to the bow's stabilizer mounting hole (secured with lock nut 21*a* as shown in FIG. 2 and FIG. 3) and the use of lightweight materials in construction, it safely folds around the stabilizer rod 21 under the flight path of the arrow and can therefore be utilized as a stabilizer which has been shown to reduce torque and increase bow performance. Also, the compactness of design, due to the tri-fold support arms, allows safe and easy transportation of the blind 10 while attached to the archery bow when performing activities such as climbing to a tree stand.

Figure 6:
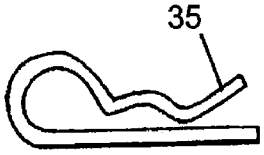
FIG. 6 is a flat view of the pin which is inserted into the stabilizing rod to secure the blind in its open position as shown in FIG. 1.

The stabilizer rod 21, as shown in FIG. 3, may be formed of any suitable material provided it is threaded, on a minimum of one end, long enough to accomodate the archery bow's stabilizer mounting hole. The opposing end consists of a round bracket 22 (as shown in FIG. 3) with a hollow lower shaft which fits tightly over the stabilizer rod 21 and is attached by forcing pins 22*b* through two predrilled holes which extend completely through the lower shaft of the round bracket 22 and the stabilizer rod 21. In addition, the stabilizer rod 21 has another predrilled hole 21*b* which is just below the sliding bracket 23 when the sliding bracket 23 is in its upmost position relative to FIG. 3. A security pin 35, as shown in FIG. 6, is then inserted through the predrilled hole 21*b* which safely secures the blind 10 into its extended, camouflaged position.

Figure 4:
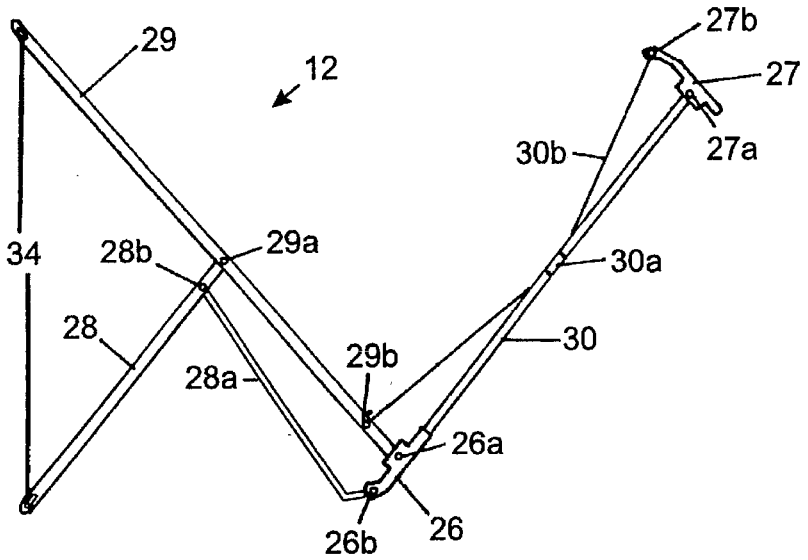
FIG. 4 shows a side view of a modified support arm which relative to FIG. 1 extends horizontally from the center, one arm on each side.
Figure 5:
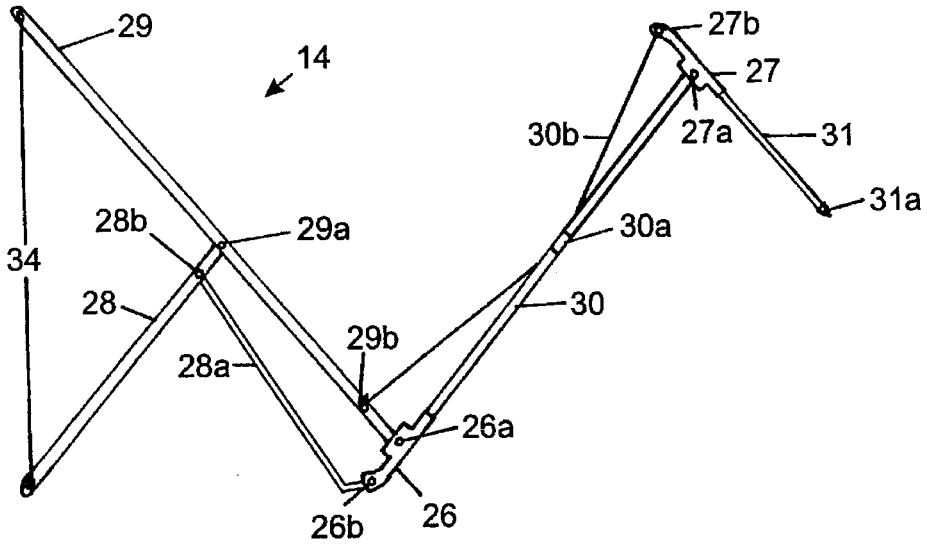
FIG. 5 shows a side view of a modified support arm which relative to FIG. 1 extends vertically from the center in a downward direction.

The round bracket 22 as shown in FIG. 3 includes eight proportionately spaced slots cut vertically into the round bracket 22, at a depth of approximately one-half of the side wall of the bracket 22, with an indented slot around the circumference. Seven of the vertical slots in the round bracket 22 accomodate a support arm of various sizes as previously detailed. Each support arm is designed identically in all ways save for three arms which are proportionately shorter beyond the last pivot bracket 27. Support arms all contain a predrilled hole 34 on the end (as shown in FIG. 4 and FIG. 5) which attaches to the round bracket 22 and the sliding bracket 23 respectively. The support arms are attached to the round bracket 22 by means of a safety wire 22*a* which threads through predrilled hole 34 of each support arm and when tightend into its slot around the circumference of the round bracket, forces each arm into its respective slot and secures them against movement during use. The eighth slot in the round bracket 22 may be used to accomodate the secured ends of the safety wire 22*a* which allows them to be safely concealed.

The sliding bracket 23 as shown in FIG. 3 contains identical slots as those described above for the round bracket 22 but whereas the slots in the round bracket 22 extend vertically top to bottom, the slots in the sliding bracket 23 extend only from the horizontal identation to the top of the sliding bracket 23 and the bottom remains solid. The slots in the sliding bracket 23 are also utilized in the same manner and are aligned exactly with their respective slots in the round bracket 22. Safely wire 23*a* is used to secure the support arms in the same manner as described above. However, the sliding bracket 23 has an extended shaft above and below, unlike the round bracket 22 which has a s mall lower shaft that tightly fits the stabilizer rod 21 to accomodate the pins 22*b* which attach it. The sliding bracket 23 has a slightly larger inside diameter than the diameter of the stabilizing rod 21, thus allowing it to slide up and down to the limits of the support arms.

All support arms (three types shown in FIG. 3, FIG. 4 and FIG. 5) are constructed to be tri-fold in that the total vertical length of the blind 10 when extended is reduced to approximately one-third of its size when collapsed. Each support arm, as demonstrated by FIGS. 3, 4, and 5, contains various pivot pins and pivot brackets which control the extension and retraction of the support arms.

Support arms, as represented in FIGS. 3, 4 and 5, may be constructed of any suitable material which may be formed into the required 'V' shape that allows the arm portions and guide wires to pivot smoothly within each other. The upper support 29 (as shown in FIG. 3) of all support arms is shaped into an inverted 'V' opening downward with respect to FIG. 3. The middle support 30 (as shown in FIG. 3) is also 'V' shaped but opens upward with respect to FIG. 3 allowing the guide wire 30*b* to seat within middle support 30 when blind 10 is in its open position. In addition, lower support 28 (as shown in FIG. 3) is 'V' shaped and positioned in the same way as upper support 29 in that the 'V' opens downward. When blind is in its collapsed position, rod 28*a* is seated in lower support 28 and thus allows blind 10 to fold into a compact size for transporting.

the construction of each support arm is not entirely 'V' shaped. The lower support 31 may consist of a solid rod of a small diameter as may rod 28*a* which attaches lower support 28 to pivot bracket 26. The guide wire 30*b* which attaches upper support 29 to pivot bracket 27 may be constructed of a small diameter flexible, non-crimping material and may also be solid in construction. Pivot pin 29*a* (as shown in FIG. 3) attaches the lower support 28 to the upper support 29 and allows movement such that a maximum support arm extension of ninety degrees perpendicular to the stabilizing rod 21 may be achieved but upon closure allows support arms to rest almost parallel to the stabilizing rod 21. Pivot bracket 26 (as shown in FIG. 3) attaches to the upper support by means of a pivot pin 26*a* and to the lower support by means of pivot pin 26*b* which connects to a small rod 28*a* which attaches by means of a pivot pin 28*b* to lower support 28. In addition, the pivot bracket 26 attaches to the middle support 30 by means of inserting middle support 30 into the circular, open end of pivot bracket 26 and slightly crimping the bracket 26 to prevent the middle support 30 from sliding out.

The middle support 30 connects to the end support 31 by means of pivot bracket 27. Middle support 30 is attached to pivot bracket 27 by means of pivot pin 27*a*. In addition, middle support 30 at a point approximately half the distance between the pivot brackets 26 and 27 has a sleeve 30*a* under which guide wire 30*b* passes. One end of guide wire 30*b* is hook shaped to be passed through opening 29*b* on upper support 29 and the other end tightly encircles pivot pin 27*b*. End support 31 is inserted into the circular, open end of pivot bracket 27 and bracket is slightly crimped to prevent end support 31 from sliding out. End support 31 has a predrilled hole 31*a*, on the end not attached to the pivot bracket 27, to which the camouflage curtain is sewn or otherwise attached.

The stabilizing/camouflaging blind 10 according to the present invention would most conveniently be provided to the consumer fully assembled with camouflage curtain 11 attached. Various patterns and colors of camouflage may be used to provide the consumer with a choice depending on the season. A carrying bag may be provided which may have a loop whereas carrying bag could be threaded on to a belt for ease of carrying when not attached to the archery bow. Carrying bag could also be left on the blind 10 when it is attached to the archery bow and being used only as a stabilizer.

The invention has been described in what is presently considered to be its most practical and preferred embodiment. It is to be made clear that the invention is not to be limited to the disclosed embodiments, but is intended to cover various modifications and equivalent arrangements included within the spirit and scope of the appended claims.

What is claimed is:

1. A camouflaging blind and stabilizer for an archery bow having an arrow rest comprising:

a rod having a threaded end for engagement in the stabilizer mounting hole of the bow so as to extend horizontally therefrom when the bow is in use;

a fixed bracket at a distal end of said rod;

a sliding bracket mounted on said rod and movable toward and away from said fixed bracket;

a first pair of support arms attached between said movable and fixed brackets, each having an end support, and each movable between a position substantially parallel to said rod and to a position extending horizontally, each on an opposite side of said rod when the bow is in use;

a second pair of support arms attached between said movable and fixed brackets, each having an end support, and each movable from a position substantially parallel to said rod to positions diverging from each other and downwardly from said rod when the bow is in use;

a third pair of support arms attached between said movable and fixed brackets each having an end support and each movable from a position substantially parallel to said rod to positions diverging from each other and upwardly when the bow is in use; a single support arm attached between said movable and fixed brackets, having an end support and movable from a position parallel to said rod to a position extending downward vertically between said second pair of support arms when the bow is in use;

a camouflage curtain attached to said end supports so as to extend out from said rod when said support arms are extended outwardly from said rod when said sliding bracket is moved toward said fixed bracket;

an unobstructed sight window in said camouflage curtain above said single support rod for exposing the bow's arrow rest when said curtain is extended.

2. The camouflaging blind and stabilizer of claim 1 wherein when said movable bracket is positioned away from said fixed bracket said curtain and said support arms are collapsed and positioned substantially parallel to said rod and it is a bow stabilizer.

3. The camouflage blind of claim 2 wherein each support arm includes three portions pivotally connected to each other, with one portion of each support arm is pivotally connected to said fixed bracket, a lower support pivotally connected between intermediate the length of said one portion and said movable bracket, whereby when said movable bracket is moved toward said fixed bracket each support arm will move from a position substantially parallel to said rod to its respective positions extending therefrom.

4. The camouflage blind of claim 1 wherein said support arms are of varying lengths so that when said support arms are extended said curtain is substantially rectangular in shape.

* * * * *